United States Patent [19]

Barnette

[11] 4,111,017

[45] Sep. 5, 1978

[54] MANUALLY OPERATED CODED SWITCH

[75] Inventor: Jon H. Barnette, Albuquerque, N. Mex.

[73] Assignee: The United States of America as represented by the United States Department of Energy, Washington, D.C.

[21] Appl. No.: 808,487

[22] Filed: Jun. 21, 1977

[51] Int. Cl.[2] ..... H01H 27/10

[52] U.S. Cl. ..... 70/293; 70/313; 70/315; 70/333 R; 200/43

[58] Field of Search ..... 70/291, 293, 305, 313, 70/315, 316, 333 R; 200/43, 45

[56] References Cited

U.S. PATENT DOCUMENTS

| | | | |
|---|---|---|---|
| 1,548,311 | 8/1925 | Hazen | 70/293 |
| 1,873,484 | 8/1932 | Rosine | 200/45 |
| 2,446,732 | 8/1948 | Whittall | 70/293 |
| 3,410,121 | 11/1968 | Morin | 70/316 X |
| 3,832,873 | 9/1974 | Barnette | 70/291 |

*Primary Examiner*—Thomas J. Holko

*Attorney, Agent, or Firm*—Dean E. Carlson; Dudley W. King; Robert Southworth, III

[57] ABSTRACT

The disclosure relates to a manually operated recodable coded switch in which a code may be inserted, tried and used to actuate a lever controlling an external device. After attempting a code, the switch's code wheels must be returned to their zero positions before another try is made.

8 Claims, 21 Drawing Figures

NEUTRAL

INCORRECT CODE

CORRECT CODE

RECODE

MANUALLY OPERATED CODED SWITCH

FIELD OF THE INVENTION

The invention relates to manually operated switches and more particularly to a codable switch requiring all code wheels be reset to their zero positions between attempts to operate the switch.

BACKGROUND OF THE INVENTION

It is frequently desirable to protect an apparatus from unauthorized use or an area from access to all but selected personnel. One way of accomplishing such desiderata is to provide access to an area or use of an apparatus only after a coded switch is properly operated. Such a switch may serve in a capacity similar to that of a combination lock into which the proper code must be inserted before the lock mechanism is released. Many switch designs have been developed and utilized in the past. Most, such as common combination locks, are limited to one code which can not be changed or altered. A number of switches can be recoded, some readily and some only with difficulty. In some situations, a plurality of differently coded switches could be used to control a like plurality of mechanisms, apparatuses or the like. Personnel having knowledge of the code for one such switch need not have knowledge of the code for any other.

It is desirable that the switch provide capability for being checked for proper coding without actually actuating or operating the switch. One known switch capable of performing in such a manner is that taught by U.S. Pat. No. 3,832,873 to Barnette, the inventor herein.

SUMMARY OF THE INVENTION

In accordance with the present invention, there is provided a coded mechanism comprising a plurality of independently rotatable code wheel assemblies on a like plurality of generally parallel axes and structure for rotatably supporting each of the code wheel assemblies on their respective axes. The code wheel assemblies are operably connected to a like plurality of independently rotatable code knobs so that each of the code knobs rotates a different one of the code wheel assemblies. Each code wheel assembly includes a location at its periphery, the angular relationship of which represents a code bit. A control cam having a function cam and a function detent is operably connected to and driven by a function knob which, along with the control cam, has neutral, try, recode and actuate positions. A mechanism controllable by the control cam releasably engages the code wheel assemblies, releasing the assemblies for rotation at the neutral and recode positions of the control cam. The try and actuate positions are achievable only when the code wheel assemblies are rotated to positions where their angular relationships represent a correct code.

BRIEF DESCRIPTION OF THE DRAWINGS

The objects and advantages of the present invention will be apparent to those skilled in the art from the following description, with reference to the appended drawings, wherein like numbers denote like parts and wherein.

DETAILED DESCRIPTION OF A PREFERRED EMBODIMENT OF THE INVENTION

Figure 1:
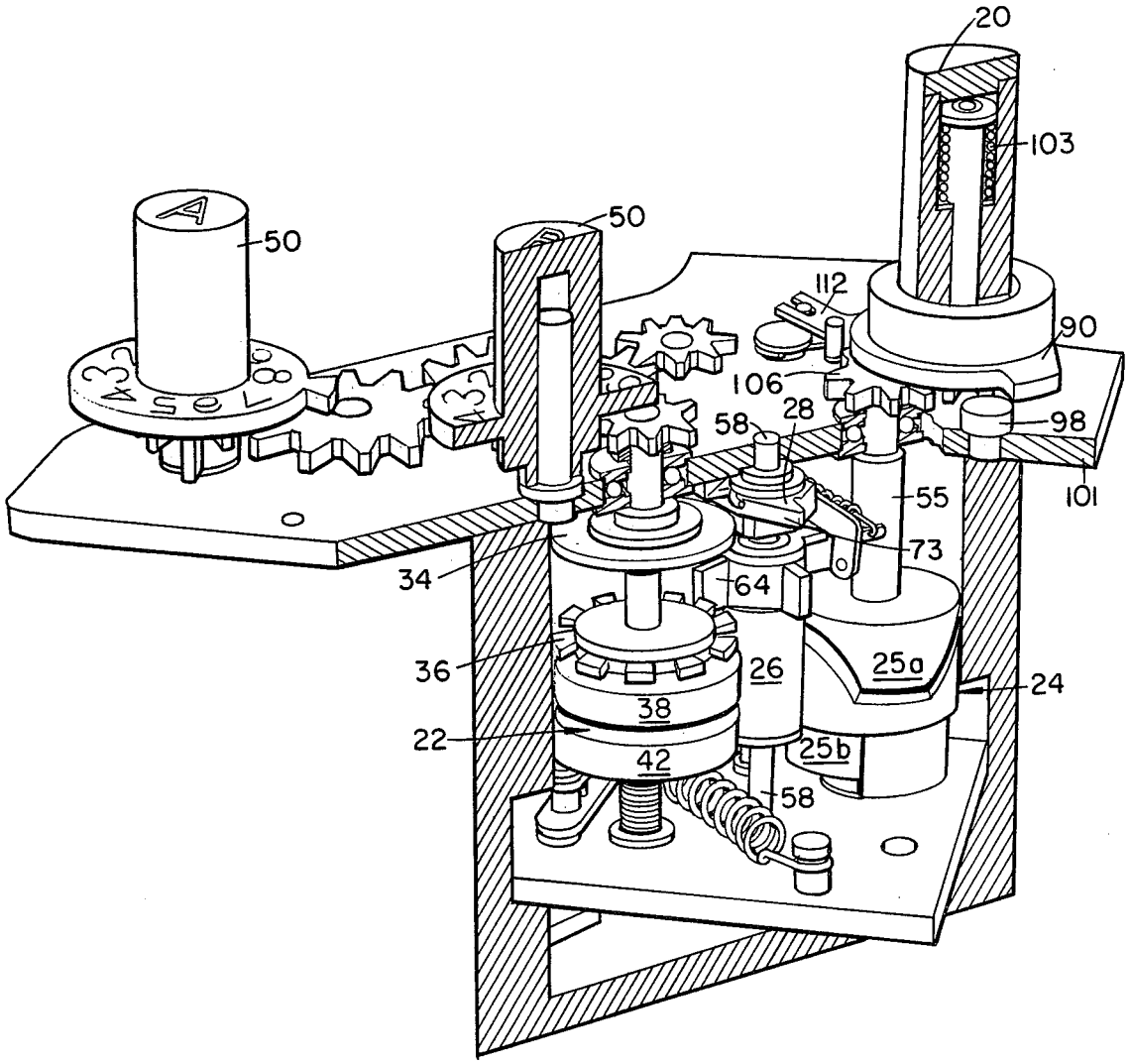
FIG. 1 is a cutaway view of a preferred embodiment in accordance with the invention.
Figure 2:
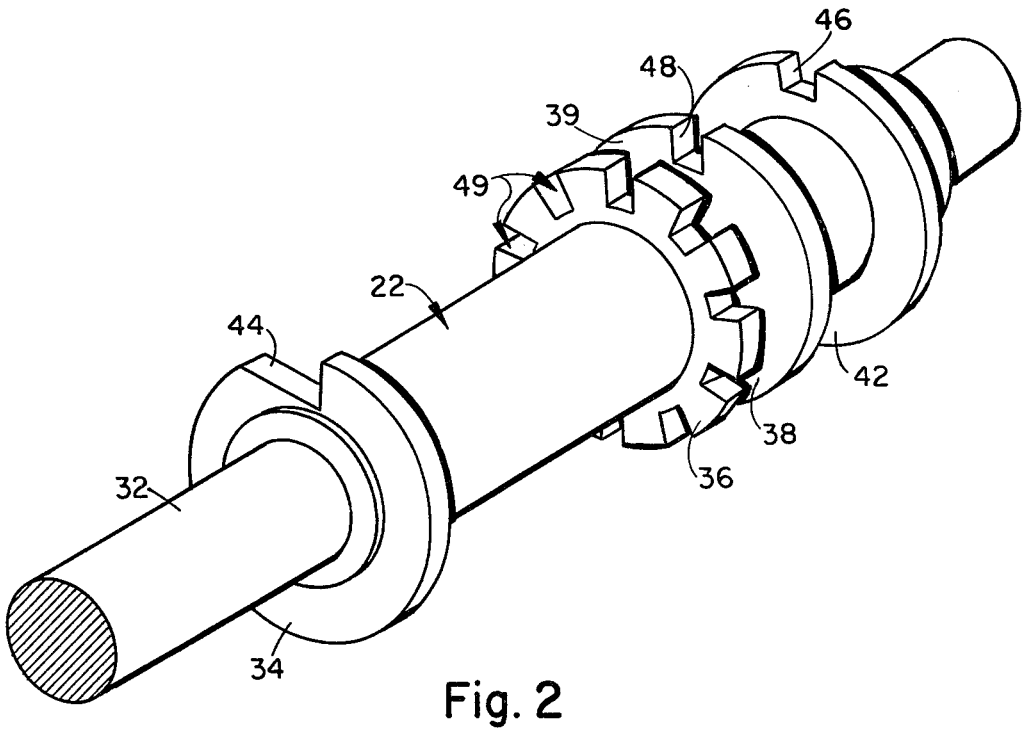
FIG. 2 perspectively depicts a code wheel assembly of the FIG. 1 embodiment.

Reference is now made to FIGS. 1, 2, 8 and 9. The principal components of the preferred embodiment comprise code wheel assemblies 22, a control cam 24, a try bar 26 and an interlock assembly 28. An exemplary code wheel assembly 22, best seen in FIG. 2, comprises a shaft 32 on which are affixed an interlock wheel 34 and an anti-pick wheel 36. A gate wheel 38 mounts on shaft 32 by a ball-detent mechanism 40, most clearly illustrated in FIGS. 3*a*–3*d*, which permits gate wheel 38 to rotate with shaft 32 when desired, but allows wheel 38 to be locked to keep it from rotating during rotation of shaft 32 in a recoding operation hereinafter to be described. A second ball-detent mechanism 41, preferably identical to mechanism 40. is attached to a base plate 42 with a pin 45 in its notch 46 to ensure shaft 32 will rotate in incremental steps.

Interlock wheel 34 comprises a notched seat 44 which receives a projecting finger 73 on the interlock assembly 28 best seen in FIG. 4. Anti-pick wheel 36 provides a plurality of radial slots 49, each slot 49 being associated with a different position or setting number on a code knob 50. The numbered positions of code knobs 50 are most clearly shown in FIG. 9. Gate wheel 38 contains a single radial gate slot 48.

Control cam 24 comprises two cams, a function cam 25*a* and a function detent 25*b*. Cam 25*a* moves in combination with a try bar operating rod 54, shown in FIGS. 3*a*–3*d*, 6*c*, 6*d*, and 8 to drive try bar 26. Cam 25*b* in combination with a spring 53 biased cam follower 52 having roller 56 seen in FIGS. 6a, 6b and 8 acts as a positioning detent for positions of neutral, actuate, try and recode. Function knob 20 operates a shaft 55 to which control cam 24 is rigidly attached. Operation of cams 25*a* and 25*b* will be described hereinbelow with reference to FIGS. 6*a*–6*d* and 7.

Figure 3A:
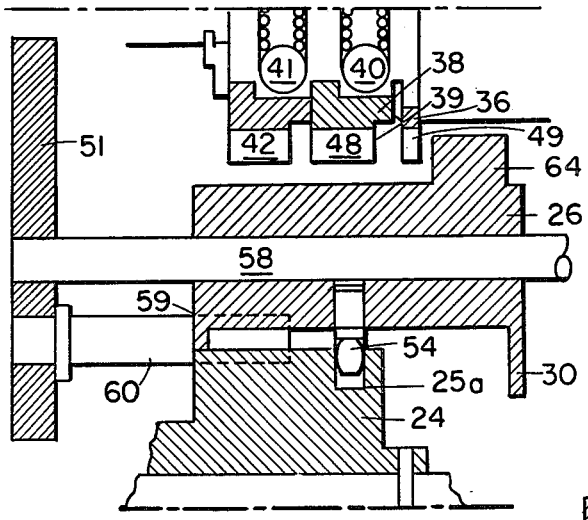
FIGS. 3*a* through 3*d* show cutaway views of a portion of the preferred embodiment in neutral, incorrect code, correct code and recode positions.

FIG. 3*a* illustrates the switch in its "zero" position, which is the position to which the switch must be turned to enable the code wheel assemblies 22 and code insertion knobs 50 to be returned to code numeral zero. Try bar 26 slides on a shaft 58, being prevented from rotating thereabout by a slot 59 integral therewith riding on a guide pin 60 affixed to a base plate 51. Cam 25*a* operates try bar 26 via try bar operating rod 54. Fence tabs 64 and an interlock tab 30 project from try bar 26.

Figure 3B:
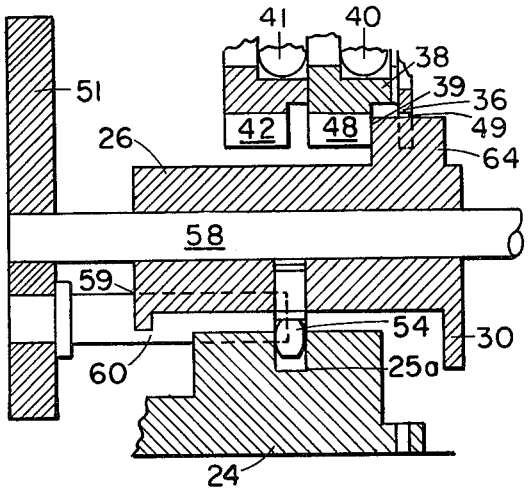

The condition of the switch when an incorrect code has been inserted on one code wheel assembly 22, is depicted in FIG. 3*b*, assuming correct code values having been inserted in all the other code wheels (not shown). When control cam 24 operates clockwise (CW)

or counterclockwise (CCW) a fence tab 64 passes through a slot 49 in anti-pick wheel 36 and contacts the front surface 39 of gate wheel 38 to thereby stop try bar 26 short of its desired position.

Anti-pick wheel 36 uniquely supplies the switch with two safing provisions. The first safing provision prevents one well known method of code picking from being performed. With the switch operated under an incorrect code, without the presence of anti pick wheel 36, the fence tab 64 would only be bearing on surface 39 of gate wheel 38 as seen in FIG. 3*b*. A skilled operator, by holding try bar 26 in its FIG. 3*b* position, could rotate control cam 24 with one hand with function knob 20 and a code wheel assembly 22 with the other hand by a knob 50 to feel when a fence tab 64 would "see" a gate slot 48. However, with the use of anti-pick wheel 36, fence tab 64 enjoys a position in a slot 49 of that wheel at the same time it bears on wheel 38. Hence, with try bar 26 fixedly positioned as illustrated in FIG. 3*b*, no code wheel assemblies 22 can be rotated because tabs 64 are locked in their slots 49.

Figure 3C:
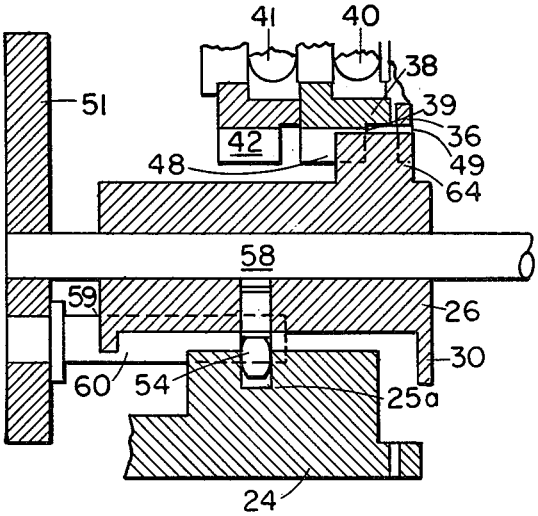

FIG. 3*c* depicts the condition of the switch when a correct code has been inserted. In this situation the gate slots 48 in all code wheel assemblies 22 are properly oriented and fence tabs 64 pass through the slots 49 in all anti-pick wheels 36 and into all gate slots 48 when control cam 24 is rotated. It can be seen in FIG. 3*c* that when try bar 26 is positioned by the function knob being in its CW or CCW position, fence tab 64 is positioned simultaneously in gate slot 48 of gate wheel 38 and in a slot 49 of anti-pick wheel 36. This arrangement, which is the safing provision supplied by wheel 36, prevents an unintentional recoding operation from being performed, for without the presence of wheel 36, an operator could hold tab 64 in gate slot 48 by leaving try bar 26 in the CW position while he rotated a code wheel assembly 22 to a new code value. This could be accomplished because a ball-detent mechanism 40 associated with a gate wheel 38 permits a code wheel assembly 22 to be rotated while its gate wheel is locked. By using the anti-pick wheel 36, a fence tab 64 positioned in slots in both wheels 36 and 38 locks the entire code assembly so that it can not be rotated. Hence, because of the presence of an anti-pick wheel, a separate operation for recoding is needed.

Figure 3D:
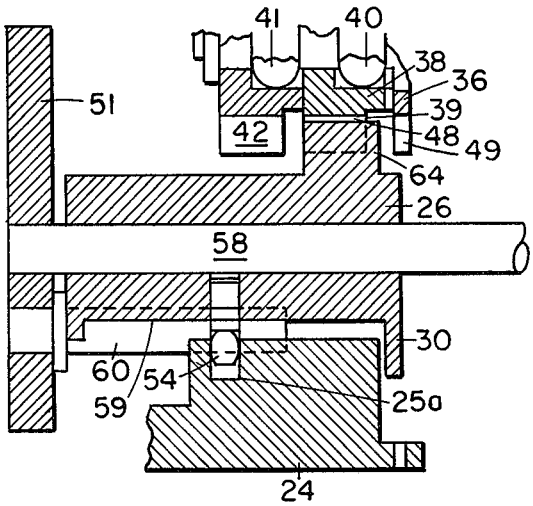

FIG. 3d illustrates a recode operation. As seen therein, after a correct code has been inserted in all of the code wheel assemblies, control cam 24 is operated so that fence tabs 64 pass through slots 48 in gate wheels 38. Try bar 26 is moved to a position where fence tabs 64 are positioned only in gate slots 48 and not in slots 49 of wheel 36. This locks gate wheels 38 against rotation. At this point, any or all code wheel assemblies 22 may be rotated to new code values, because they are permitted to rotate by ball-detent mechanism 40 when gate wheels 38 are locked. After any new code values have been inserted, control cam 24 may be used to return try bar 26 to its neutral or zero (FIG. 3*a*) position which unlocks gate wheels 38. With the new code values inserted, the code wheel assemblies 22 may then be returned to their zero positions.

Figure 4A:
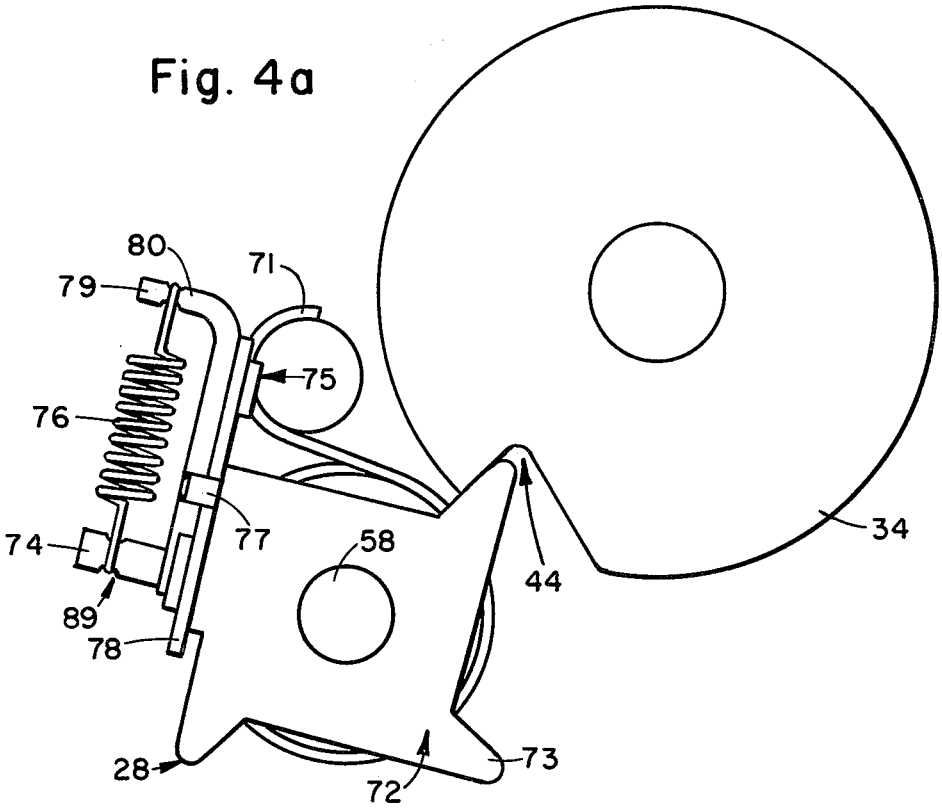
FIGS. 4*a* and 4*b* show an interlock wheel and interlock assembly of the preferred embodiment.
Figure 4B:
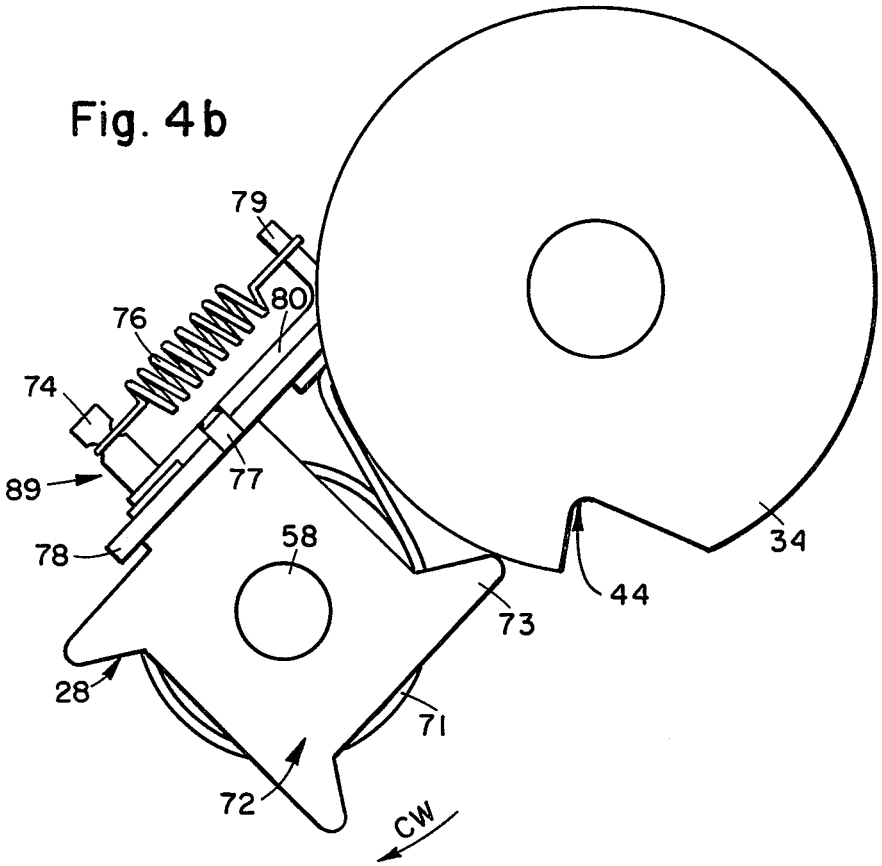

FIGS. 4*a* and 4*b* and FIGS. 5*a*–5*d* illustrate the interlock assembly 28 and interlock tab 30 combination. FIG. 4*a* shows the switch at its zero position, with interlock assembly 28 mounted on shaft 58. Interlock assembly 28 comprises a cam follower 72 having fingers 73 being biased by a spring 71, and a latch assembly 89 comprising an inner plate 78 and an outer plate 80 biased by spring 76. Fingers 73 load into notched seat 44 of interlock wheel 34. FIG. 4*b* demonstrates the effect of turning any one of the code wheel assemblies to a number other than zero; notch 44 pushes a finger 73 turning cam follower 72 clockwise against spring 71.

Figure 5A:
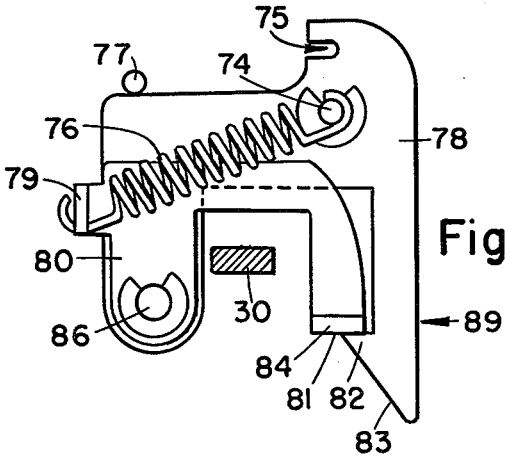
FIGS. 5*a* through 5*d* illustrate other components of the interlock assembly.

FIGS. 5*a*–5*d* illustrate the interaction of plates 78 and 80 of the latch assembly 89 mounted on cam follower 72 with interlock tab 30 of try bar 26, FIG. 5*a* showing the zero condition of FIG. 4*a* and FIGS. 5*b*, 5*c* and 5*d* showing the operated condition of FIG. 4*b*. As can be seen, plate 78 is pivotally affixed on cam follower 72 with a pin 74, the latter also acting as an anchor for spring 76. Spring 71, which biases cam follower 72 clockwise as seen in FIGS. 4*a* and 4*b*, also biases clockwise inner plate 78, as seen in FIGS. 5*a*–5*d*, because one of its ends is held in a notch 75 in plate 78. Restoring torque to cam follower 72 is thereby applied through pin 74. A stop pin 77 mounted on cam follower 72 stops inner plate 78 from clockwise rotation beyond that seen in FIGS. 5*a* and 5*d*.

Outer plate 80, biased clockwise by spring 76 attached to a tab 79 thereon, pivotally mounts on inner plate 78 via pivot pin 86. Plate 80 clockwise rotation is stopped by a tab 84 on plate 80 which rests on a point 82 on plate 78.

Figure 5B:
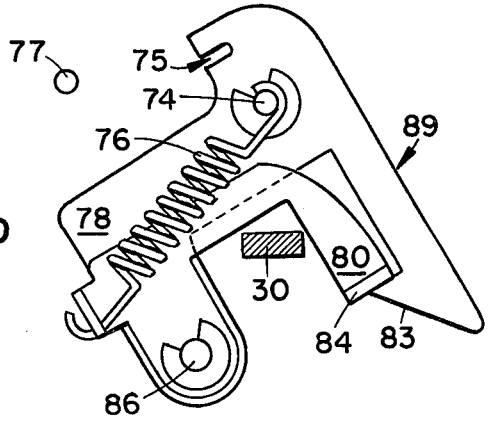

When the function knob 20, seen in FIG. 1, is in its neutral position and all the code knobs 50 are at their zero positions, as seen in FIG. 5*a*, interlock tab 30 on try bar 26 is in its maximum upward position. As set forth in detail previously, movement of function knob 20 either CW or CCW depresses interlock tab 30 as shown in FIGS. 5*b*–5*d*.

A code other than all zeros being inserted will be indicated by at least one of the code knobs 20 moving an interlock wheel 34 as illustrated in FIGS. 4*a* and 4*b*. If interlock assembly 28 is moved relative to try bar 26, the FIG. 5*b* action will result, with the tab 84 of outer plate 80 striking point 82, the interlock tab 30 rotating the plates 78 and 80 about pivot pin 74.

Figure 5C:
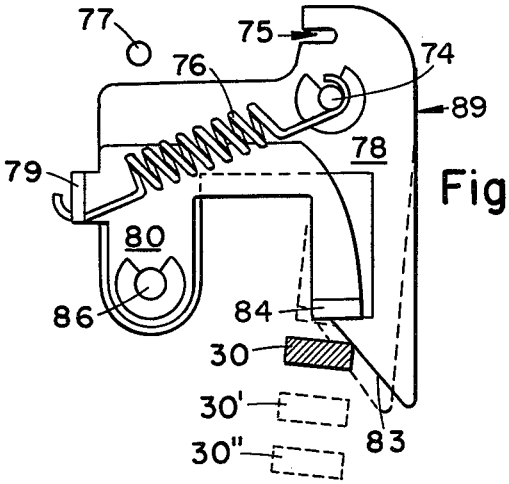
Figure 5D:
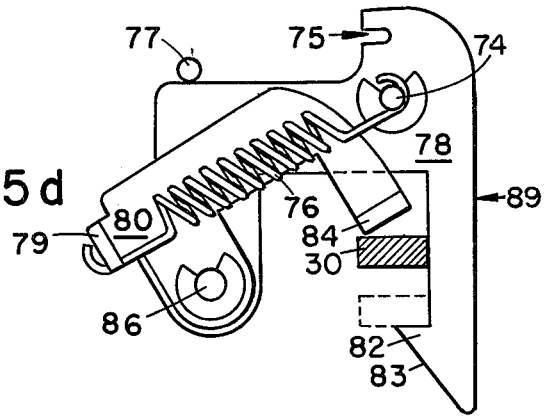

FIG. 5*c* illustrates the effect of moving try bar 26 to a position attained with a wrong code by a solid line view of interlock tab 30, a first dotted view 30' illustrating the position attained with a good code, and recode position being shown by a second dotted view 30''. In attaining any of these positions, interlock tab 30 slides along the surface of outer plate 80 past tab 84 and then, as the plate assembly comprising plates 78 and 80 rotates clockwise, from the bias of spring 71, makes contact with the slanted edge 83 of point 82 on plate 78. This occurs before fence tab 64 contacts the surface of gate wheel 38 to position the latch assembly 89 prior to detection of a wrong code. The dotted line FIG. 5*c* view of point 82 occurs when tab 30 moves sufficiently to allow plate 78 to rotate against stop pin 77. This position is illustrated in FIG. 5*d*.

When try bar 26 returns to its neutral position from any of the three FIG. 5*c* positions, its tab 30 cams point 82 on inner plate 78 outward against the resistance of spring 71 and then strikes the tab 84 on outer plate 80 to pivot plate 80 about pin 86, stretching spring 76. Tab 30 then rides over point 82 and inner plate 78 moves clockwise, bringing point 82 under tab 30, the position illustrated in FIG. 5*d*. This occurs before fence tab 64 is completely removed from slot 49 in anti-pick wheel 36 and is necessary to retain the anti-pick feature of the lock provided by anti-pick wheel 36 as previously described.

If any attempt is made to actuate control cam 24 while the switch is in the FIG. 5*d* position, try bar 26 and tab 30 only move on shaft 58 between the full line and dotted line positions. The only way to remove the switch from this locked position is to bring all code wheel assemblies to their zero positions. When the code wheel assemblies 22 are brought to their zero positions, biasing spring 71 rotates interlock assembly 28 CCW, bringing all interlock fingers 73 into rotated slots 44 on interlock wheels 34. This action disengages tab 84 from tab 30 to permit the latch assembly 89 to return to its FIG. 5*a* position. A new code insert operation may then be performed. In this manner the unique interlock arrangement of a switch in accordance with the invention makes it necessary to return the switch to its zero condition after any operation of the switch has been attempted before another operation thereof can be performed. This feature makes it very time consuming to attempt to break the code and thereby operate the switch.

The operation of function knob 20 and control cam 24 will be described with reference to FIGS. 6*a*–6*f*. The skirt 90 of function knob 20 will be represented from its top on FIGS. 6*e* and 6*f*. Associated with skirt 90 is a pivoting arm 112 having protruding pins 110 spring biased against a surface 100 of skirt 90. Surface 100 terminates in the CW direction in cam surface 96. Function knob skirt 90 also has a downwardly protruding lug 94, at such a radial location that it will strike a stop pin 98 mounted on a top plate 101 of the switch. Function knob 20 may be pulled upwardly against a spring 103 sufficiently far that lug 94 clears stop pin 98.

Figure 7:
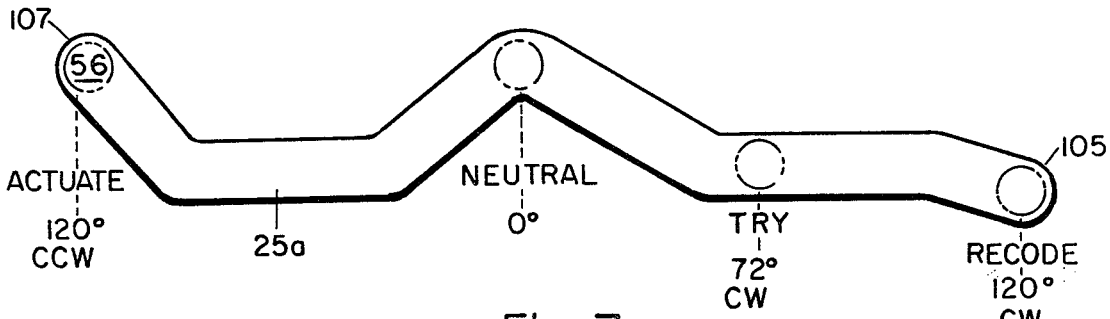
FIG. 7 schematically illustrates the path of the try bar operating rod on the function cam of FIGS. 6*c* and 6*d.

It will be noted that because of gearing 106 of the preferred embodiment, control cam 24 happens to turn in the opposite direction to function knob skirt 90. The gearing could easily be arranged so that the control cam 24 and the function knob 20 would turn in the same direction. Cam 25*a* comprises a groove cut in the surface of control cam 24. One end of try bar operating rod 54 is positioned in this groove. Cam 25*a* is shown in FIG. 6*c* and 6*d* as an arcuate groove for the sake of clarity in explaining operation of the switch of the invention, but is actually complex in shape as seen in FIG. 7, which shows try bar operating rod 54 in cam 25*a* at the various positions it assumes under different modes of switch operation. The degree markings for the different positions of try bar operating rod 54 seen in FIG. 7 illustrate the angular displacement control cam 24 experiences during switch operation of the preferred embodiment. FIG. 7 shows that operating rod 54 experiences axial motions with respect to control cam 24.

Figure 6A:
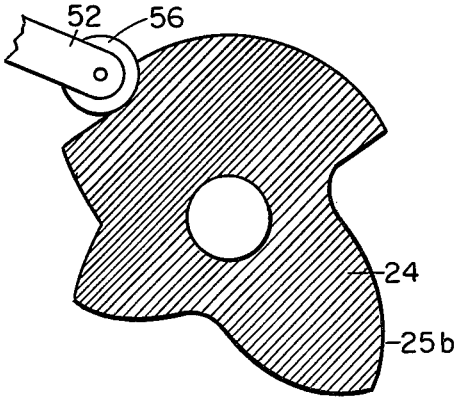
FIGS. 6*a* through 6*f* show function detent, function cam and try bar control rod as well as function knob cam and switch lever portions of the preferred embodiment.

Referring now to FIG. 6*a*, cam 25*b* comprises a complex surface on the body of control cam 24. A spring biased lever arm mechanism 88 comprises elbow arms 52, spring 53, pivot pin 99 and cam roller 56. Mechanism 88 via roller 56 through contact with cam 25*b* supplies force bias to detent control cam 24 to its positions corresponding to CCW (120°), neutral (0°), CW (72°) and recode (120°CW) positions for function knob 20.

Figure 6B:
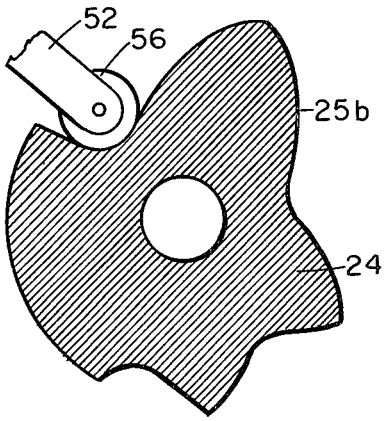
Figure 6C:
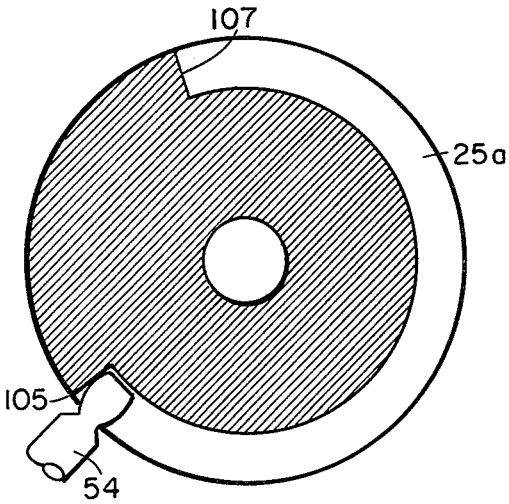
Figure 6D:
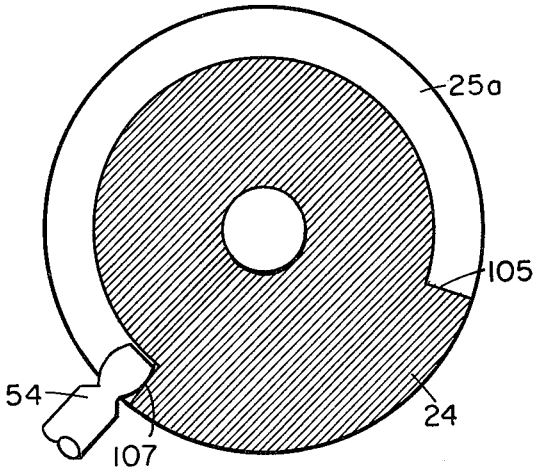
Figure 6E:
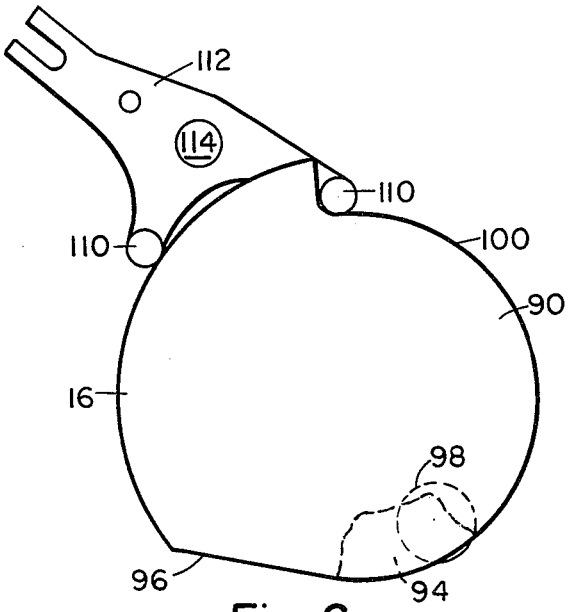

FIGS. 6*b* and 6*d* show the control cam when a proper code has been inserted in the switch and the control cam has been rotated to its CW position, (CCW for knob 20). At this time the control cam can not be rotated clockwise beyond the position illustrated because try bar operating rod 54 is locked against one end 107 of cam 25*b*. The control cam only reaches a condition between the position depicted in FIGS. 6*a* and 6*b* for cam detent 25*b*. It should be noted that if an improper code has been inserted into the switch, roller 56 contacts only the first rising portion of cam 25*b* to either side of the neutral position so that if the function knob is released, roller 56 will rotate the control cam back to the neutral condition.

FIGS. 6*a* and 6*c* show the control cam during the performance of a switch recode operation. To perform the operation, the function knob is pulled up against its spring bias 103 seen in FIG. 1. With knob 20 and hence skirt 90 held in its up position and rotated CW, the cam 24 reaches the condition shown. The control assembly can not be rotated past the position shown because try bar operating rod 54 is locked against one end 105 of cam 25*a*. Roller 56 is positioned in cam 25*b* in FIGS. 6*b* and 6*d* so that it supplies a holding force. The assembly can be returned to the neutral condition by rotating control knob 20 in a CCW direction.

FIG. 6*d* shows control cam in the CCW condition for knob 20, illustrating one of the unique features of a switch in accordance with the present invention. After a proper code has been inserted, the switch is brought to this condition by rotating function knob 20 CCW. The assembly is rotated until try bar operating rod 54 contacts the end 107 of cam 25*a*, which locks the assembly against further CCW rotation. At the same time, roller 56 is disposed in cam 25*b* such that it supplies a holding or detent force to the assembly. When the control cam 24 is locked in the FIG. 6*d* position, try bar interlock assembly 28 and interlock tab 30 are in their FIG. 5*d* condition. When the switch's control assembly is in this disabled condition, all of the code assemblies 22 must be returned to their zero position, which returns interlock assembly 28 and latch 30 to their FIG. 5*a* condition, for the switch to be operated again. Then a proper code must be inserted and the function knob 20 rotated CW to its neutral position. Before the control assembly can again be actuated, all the code wheel assemblies must be returned to their respective zero positions. This places the switch into a condition in which any desired mode of operation may be performed The requirement for reinsertion of the code before the switch is returned to neutral is accomplished by the upturned end 107 of cam 25*a* as shown at the CCW position in FIG. 7. Although the function knob 20 has moved only in the CCW direction, try bar 26 has moved down to the correct code position of FIG. 5*c* and back up to the interlocked condition of FIG. 5*d*. Returning all code knobs to zero restores the reset position of FIG. 5*a*,.

Figure 6F:
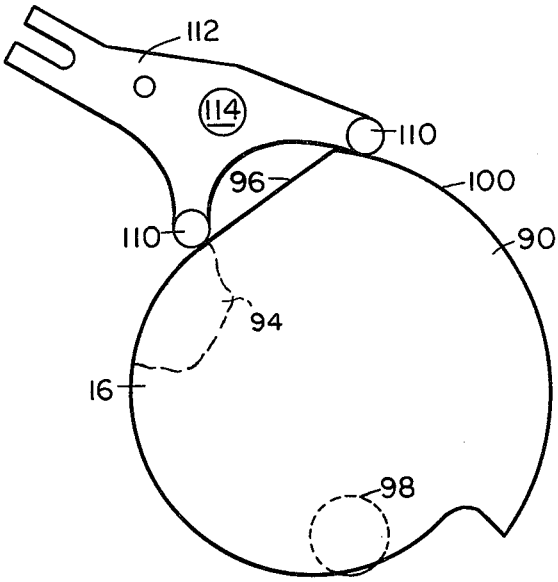
Figure 8:
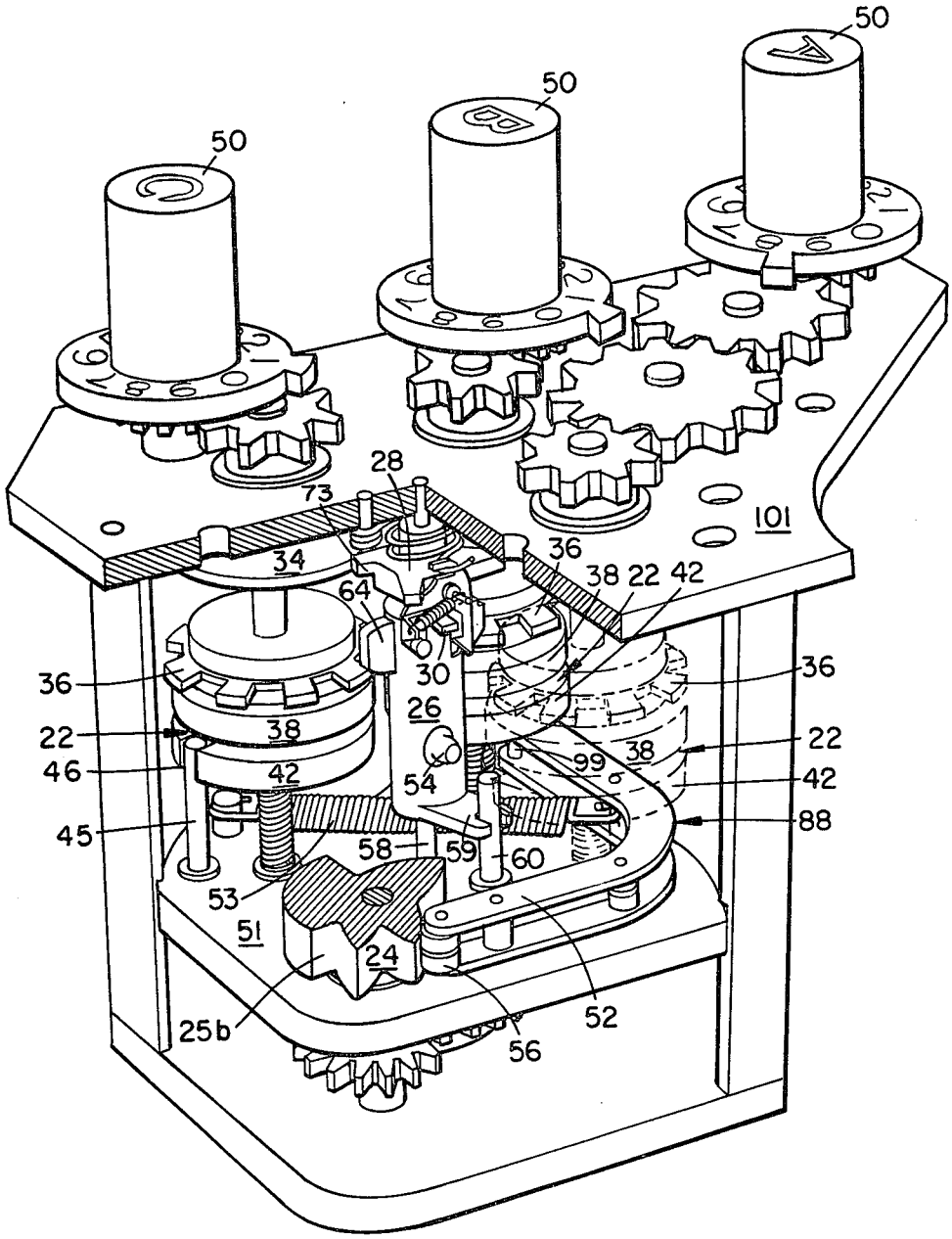
* and FIGS. 8 and 9 are other views of the FIG. 1 embodiment.
Figure 9:
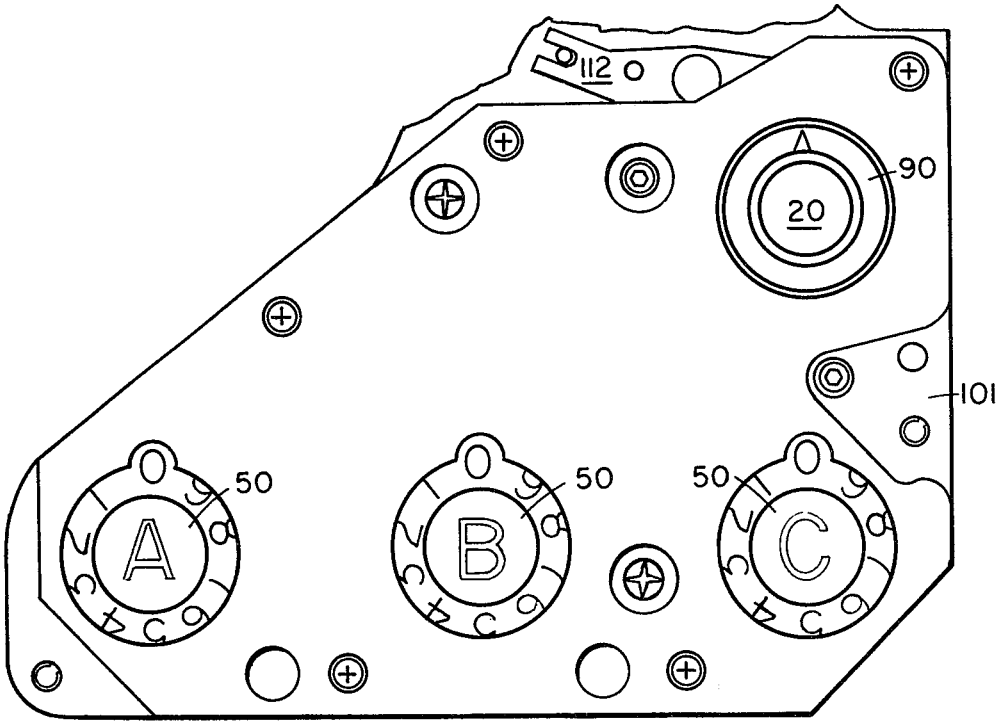

FIG. 6*f* shows that when the skirt of function knob 90 has attained its CCW position, a pin 110 of arm 112 has ridden up cam surface 96 and rotated arm 112 about its center pin 114. This movement may be used to control, for example, a battery actuator or other device.

Although the preferred embodiment of a switch in accordance with the invention comprises three code wheel assemblies, it will be appreciated by those skilled in the art that other switches in accordance with the invention may be constructed having one, two or more than three code wheel assemblies. It will be noted that code values can be inserted into the code wheel assemblies in any order because there is no operational interlock between the code wheel assemblies requiring their activation in a particular order.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

What I claim is:

1. A coded mechanism comprising:

a plurality of independently rotatable code wheel assemblies on a like plurality of generally parallel axes; means for rotatably supporting each of said assemblies on said axes, said code wheel assemblies being operably connected to a like plurality of independently rotatable code knobs for rotating said assemblies, each of said assemblies including a location at its periphery whose angular relationship is representative of a code bit;

a control cam comprising a function cam and a function detent operably connected to a function knob, said control cam and said function knob having neutral, try, recode and actuate positions; and means controllable by said control cam for releasably engaging said code wheel assemblies, said assemblies being released for rotation at neutral, actuate and recode positions of said control cam, said try, recode and actuate positions being achievable only when said code wheel assemblies are rotated to positions where their angular relationships are representative of a correct code.

2. The invention of claim 1 further comprising a try bar containing a fence tab for each of said code wheel assemblies, said code wheel assemblies further comprising anti-pick wheels, said fence tab being positionally controlled by said function cam and thereby releasably engagable with said wheels to bar rotation of said assemblies when said control cam is in its try position.

3. The invention of claim 2 wherein said code wheel assemblies comprise radial gate slots and said bar is driven by said function cam through said radial gate slots in each of said code wheel assemblies as said function knob is turned to said actuate, recode and try positions from said neutral position, said radial gate slots being positioned to receive said fence tabs only if a correct code is represented by the angular positions of said code wheel assemblies.

4. The invention of claim 3 wherein said try bar is slidably mounted on a rod whose longitudinal axis is parallel to the axes of said code wheel assemblies, said plurality of code wheel assemblies being disposed about said try bar rod so that said fence tabs on said try bar are simultaneously operatively engagable with all of said plurality of code wheel assemblies.

5. The invention of claim 4 wherein said code wheel assemblies further comprise interlock wheels, each of said wheels having a rotatable seat with an interlock assembly operatively connected to said try bar, said try bar further comprising an interlock tab, said interlock tab being releasably engagable with said interlock assembly, said interlock assembly preventing said function knob from being rotated from the neutral and actuate positions unless all code knobs have been returned to their zero positions after any other attempt to rotate said function knob.

6. The invention of claim 5 wherein said try bar comprises a try bar operating rod affixed thereto engaged with said function cam to provide operable engagement between said try bar and said function cam.

7. The invention of claim 1 further comprising means for actuation operatively controlled by said function knob.

8. The invention of claim 7 wherein said actuation means comprises a cam surface integral with said function knob and a spring biased lever retained thereagainst so that rotation of said function knob to said actuation position moves said lever.

* * * * *